United States Patent [19]

Ristic

[11] 4,130,111

[45] Dec. 19, 1978

[54] VENTILATING SYSTEM

[76] Inventor: Cedomir B. Ristic, 23820 Harper, St. Clair Shores, Mich. 48080

[21] Appl. No.: 789,612

[22] Filed: Apr. 21, 1977

[51] Int. Cl.[2] ..... F23J 11/00

[52] U.S. Cl. ..... 126/299 D; 55/269

[58] Field of Search ..... 126/299 D, 121; 55/269, 55/DIG. 36; 165/119

[56] References Cited

U.S. PATENT DOCUMENTS

| | | | |
|---|---|---|---|
| 2,277,381 | 3/1942 | Black | 126/121 X |
| 2,629,587 | 2/1953 | Tignor | 55/269 X |
| 3,815,336 | 6/1974 | Rigo | 55/269 |
| 3,982,588 | 9/1976 | Darm | 126/299 D X |

FOREIGN PATENT DOCUMENTS

| | | | |
|---|---|---|---|
| 2441687 | 3/1976 | Fed. Rep. of Germany | 126/299 D |

*Primary Examiner*—Carlton R. Croyle
*Assistant Examiner*—Michael Koczo, Jr.
*Attorney, Agent, or Firm*—Basile and Weintraub

[57] ABSTRACT

In a building, a ventilating hood is disposed over a kitchen cooking unit. The hood has an exhaust duct and a return duct, both extending through the roof to the exterior of the building. An exhaust blower is connected to the exhaust duct, and an intake blower is connected to the intake duct outside the building. The hood includes an air filter which has a plurality of fresh air conduits extending therethrough. The ventilating system removes smoke, vapors and cooking odors from the work area disposed over the cooking unit and provides fresh air to the same work area. The smoke, vapors, cooking odors and the like pass through the air filter on their way to the exhaust duct, while air from the intake duct is directed through the filter air conduits such that the exhausted, heated air preheats the fresh air returned from the hood to the work area above the cooking unit. In one embodiment of the invention the ventilated hood is provided with an electric heater which functions to heat the fresh air to a desired temperature for supplementing the heat exchange occurring in the filter air conduits.

1 Claim, 3 Drawing Figures

VENTILATING SYSTEM

BACKGROUND OF THE INVENTION

I. Field of the Invention

The present invention relates generally to ventilating systems for buildings and, more particularly, to means for removing heat and fumes from above a working surface in a kitchen area and returning fresh air to the working area, which fresh air is preheated.

II. Description of the Prior Art and Patentability Statement

Exhaust hoods designed for permanent installation over stoves and, particularly, cooking appliances in commercial kitchens of the type which are particularly adapted for use for frying, broiling and grilling are well known in the prior art. Typically, such exhaust hoods are provided with a duct system and a fan of some type so that the hood captures most of the smoke, vapors and odors given off and exhausts these heated gases through an exhaust duct to the outside of the building in a continuous manner. Prior art exhaust hoods, and particularly those disclosed in U.S. Pat. Nos. 3,800,689, 3,890,887, and 3,837,269, have made provisions for providing fresh, cool air through the exhaust hood. Typically, this fresh air is injected by the exhaust hood downward at the front thereof which achieves a number of desirable objectives. Since the exhaust hood normally overlaps the cooking surface, this air is injected generally in the regions where the cooks are standing, thereby providing cooler working conditions and a deterrent to the flow of smoke upwardly from the capture area of the exhaust hood. It also provides a controlled filter replacement for the air, smoke and the like exhausted and makes the exhausting easier. One significant concern of those who pay fuel bills for buildings is the cost of heating fresh air introduced into the building to make up for air exhausted. The volume of air involved can be particularly large in restaurants having large hoods with high exhaust capacity for the removal of fumes and contaminants from the kitchen.

Of the above identified patents, U.S. Pat. Nos. 3,837,369 and 3,800,689 each disclose kitchen ventilating hoods that are disposed over the cooking appliance in a kitchen, and each has an exhaust duct and a return duct. The systems are both similar in that they are provided with means for bypassing some of the hot air exhausted from the kitchen to return the bypassed portion back to the kitchen so as to preheat some of the air being brought in from the outside. U.S. Pat. No. 3,890,887 illustrates a more conventional hood wherein cold air is returned to the kitchen, while hot air is exhausted therefrom. U.S. Pat. No. 3,521,582 discloses a heating system wherein hot air from a conventional furnace preheats the fresh air coming into the furnace as the hot exhaust gases are exhausted from the furnace. While there are similarities in the aforementioned prior art apparatuses to that disclosed in the instant application, it is the inventor's belief that the subject matter disclosed and claimed herein constitutes a patentable improvement over the prior art.

SUMMARY OF THE INVENTION

The present invention, which will be described subsequently in greater detail, comprises a ventilating system for a building wherein the system has a vent hood employed over a cooking surface in a kitchen wherein heat and fumes to be exhausted are generated. Exhaust means are connected to the hood for removing air from under the hood and exhausting it through an air filter within the hood and to the atmosphere outside the building. Intake means associated with the hood are provided for drawing in fresh air from outside the building and introducing the fresh air into the interior of the ventilating hood wherein the fresh air is directed through a plurality of fresh air conduits extending through the air filter such that the hot exhaust air preheats the fresh air. The preheated fresh air is directed toward the cooking surface, as desired. Temperature sensor means are provided in the intake means to control a separate heating unit which functions to provide additional heat to the fresh air supply.

It is therefore an object of the present invention to provide a new and improved ventilating system for buildings for removing heat and fumes from above a cooking surface and wherein the heat and fumes are used to preheat fresh air supplied to the cooking surface.

It is a further object of the present invention to provide a ventilating system of the type disclosed which is simple in its construction and design and, thus, one which is relatively inexpensive to manufacture and maintain.

Other objects, advantages and applications of the present invention will become apparent to those skilled in the art of ventilating systems when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
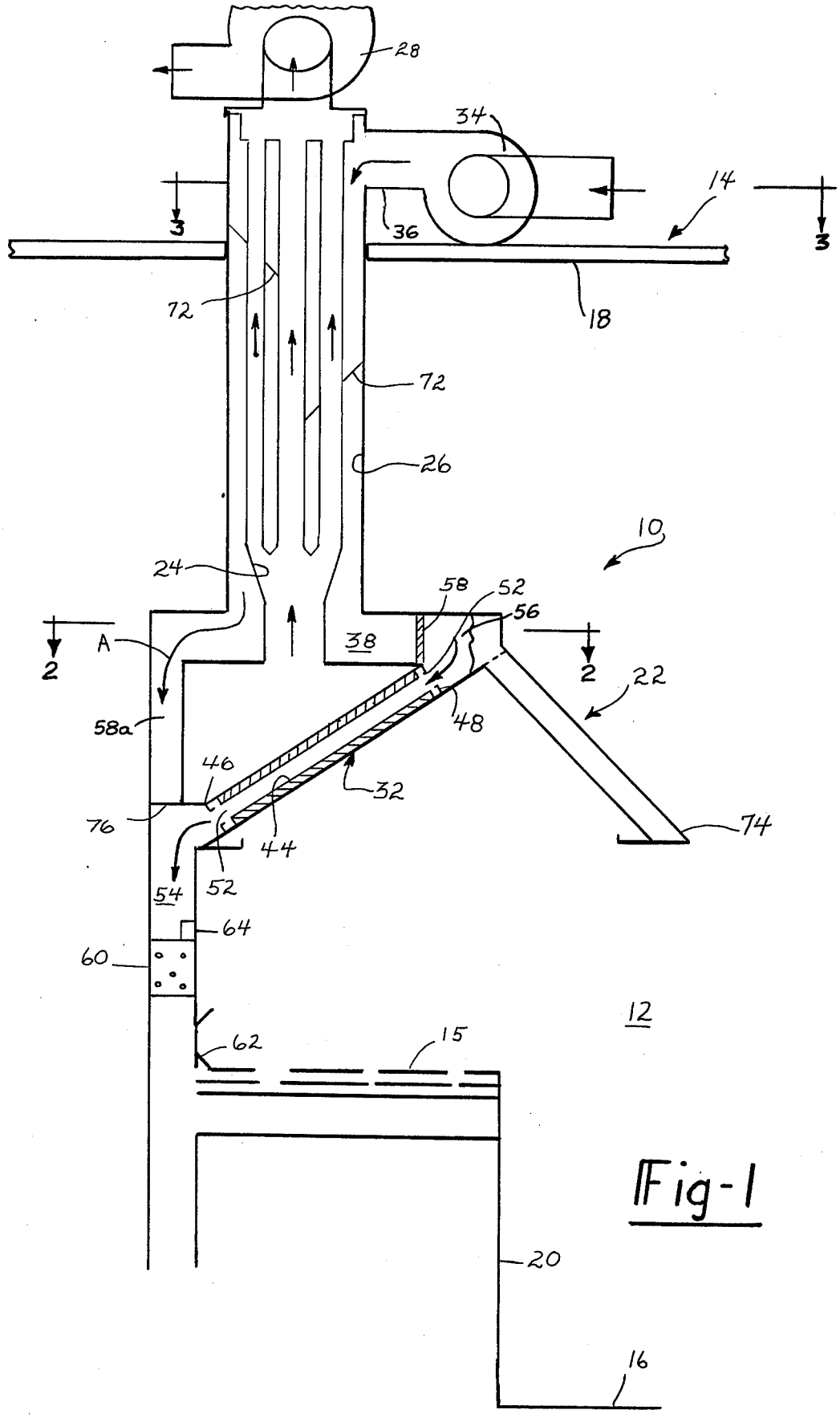
FIG. 1 is a schematic, cross-sectional view through a kitchen illustrating a ventilating system constructed in accordance with the principles of the present invention.

Referring now to the drawings and, in particular, to FIG. 1 wherein there is illustrated one example of the present invention in the form of a ventilating system 10. The ventilating system 10 is mounted within the kitchen 12 of a building 14 and disposed between the floor 16 and the roof 18 of the building 14. The kitchen 12 includes a cooking unit 20 that has a cooking surface 15 thereon which may be heated by electricity, gas or other conventional means. A hood 22, disposed over the cooking unit 20, has an exhaust duct 24 and a return or inlet duct 26. Both ducts extend up from the hood 22 and through to the roof 18 on the building 14. An exhaust blower 28 is connected to the exhaust duct 24 and has a discharge outlet to atmosphere such that hot gases and the like are drawn upwardly through a grease filter 32 into the exhaust duct 24 and exhausted through the discharge outlet to the atmosphere, all of which is conventional and well known to those skilled in the art of ventilating systems. An intake blower 34 has a fresh air inlet 36 and draws in fresh air into the return duct 26 which, in turn, directs the fresh air to an interior chamber 38 within the ventilating hood 22, all of which will be described in greater detail hereinafter.

The assembly, as thus far described, is capable of removing heated air from under the hood 22 through the filter 32 and discharging the heated air through the outlet duct 24 to the atmosphere. The return or intake blower 34 is capable of drawing fresh air in from the atmosphere and delivering the fresh air through the duct 26 to the hood chamber 38.

Figure 2:
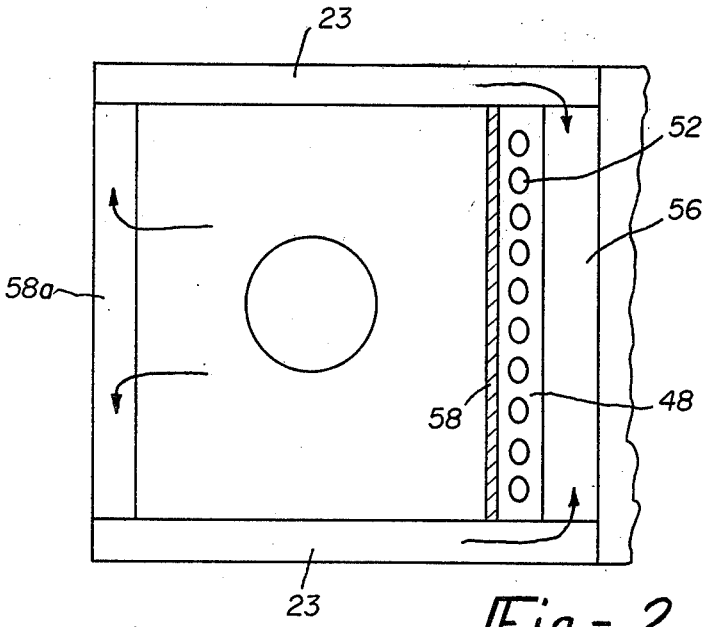
FIG. 2 is a fragmentary, sectioned, perspective view of the ventilating system illustrated in FIG. 1 of the drawings taken along line 2—2.

As can best be seen in FIGS. 1 and 2, the filter 32 comprises a filter portion 40 which may be fabricated from a metal mesh which functions in the conventional manner to filter out grease and other contaminants from the heated air rising above the cooking surface 15 and to prevent the grease and other contaminants from being exhausted into the atmosphere via the exhaust blower 28. The filter 32 extends the full length of the ventilating hood 22 such that all of the heated air being exhausted through the hood 22 must pass through the filter 32. The filter 32 further comprises a plurality of laterally spaced, longitudinally disposed air conduits 44. Each of the air conduits 44 is a cylindrically shaped metal tube that is connected to the filter 32 in such a manner that it extends through the mesh filter portion 40 to the opposite ends of the filter 32 through metal partitions 46 and 48 such that the opened ends of each of the tubes 44 is sealed from the air spaces that are defined by the metal mesh portion 40. The upper ends 52 of each of the air conduits 44 communicate directly with the air passage 38, while the lower ends 50 of each of the plurality of tubes 44 communicate with a lower air chamber 54 (FIG. 1). As can best be seen in FIG. 2, the inlet air duct 26 communicates with the chamber 38 which, in turn, is separated from the remaining portions 56 of the vent 22 by means of a partition 58. The partition 58 directs the air coming from the inlet duct 26 in such a manner that the air flows downwardly toward the back side 58*a* (FIG. 1) of the interior of the ventilating hood 22, as indicated by the arrows A and B in FIGS. 1 and 2 respectively. The air flows down the back side 58a of the vent 22 and across the rear portion thereof and back upwardly along the ends of hood 22 into the chamber 56, as indicated by the arrows C in FIG. 2. The air then flows into the tube openings 52, through the air tubes 44, and into the air chamber 54 at the rear portion of the vent 22. From the chamber 54 the air flows through an electrical heating device 60 and through an exhaust slot 62 which extends completely across the rear portion of the vent hood 22. The electrical heating unit 60 includes a temperature sensor 64 which functions to sense the temperature of the fresh air passing through the chamber 54. If the temperature is below a predetermined amount, the temperature sensor 64 functions to actuate the air heater 60 such that the air passing therethrough on its way to the outlet slot 62 is heated to a desired level.

Figure 3:
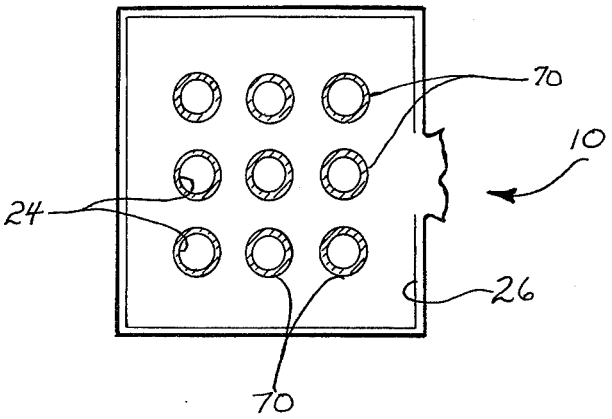
FIG. 3 is a fragmentary, cross-sectional view of the ventilating system taken along Line 3—3 of FIG. 1.

From the foregoing description, it can be seen that the air heated at the cooking surface 15 is removed by the action of the exhaust fan 28 upwardly through the filter 32 where, at the same time, the heated air passing through the filter 32 and around the metal air conduits 44 heats the fresh air passing through the air conduits 44. Thus, the air conduits 44 and the filter 32 function as a heat exchanger to preheat the fresh air passing from the inlet duct 26 and into the slots 62. It can also be seen from FIGS. 1 and 3 that the outlet duct 24 comprises a plurality of tubular members 70 which extend upwardly to define a series of flow paths through which the fresh air must flow. The system can be provided with a plurality of baffles, such as shown at 72, which function to control the flow path of the air through the air duct and around the exhaust tube 70 in a tortuous manner so as to further preheat the air that is being brought in from the outside atmosphere.

It should be noted that the exhaust slot 62 provides just one example for exhausting the preheated air into the working space. The exhaust slot 62 can be located in a variety of places such as at the upper portions 74 of the hood 22 so that the air drops downwardly to the forward portions of the ventilating system, as suggested by some of the prior art apparatuses.

It can thus be seen that the present invention provides a unique ventilating system which utilizes the heated exhaust gases for preheating fresh air being introduced into a kitchen area. The same is accomplished in an efficient and inexpensive manner in that it requires less fuel to heat the kitchen during winter months, thus, representing a savings at a time when the frugal use of energy is becoming a national priority. A damper provided at 76 may be opened during the summer months so that the fresh air is communicated directly to the chamber 54 and not preheated by the filter 32, as it would not be desirable to provide heated air into the kitchen during the summer months.

While the invention has been illustrated and described in detail in the drawings and foregoing description, the same is to be considered as illustrative and not restrictive in character, it being understood that only the preferred embodiment has been shown and described and that many changes and modifications may be had, all coming within the spirit of the invention and the scope of the appended claims.

What is claimed is as follows:

1. A ventilating system comprising:

a vent hood;

exhaust means having an inlet coupled to said hood and including a filter, an exhaust duct and an exhaust blower means for removing heated air from under said hood and through said filter and said exhaust duct to discharge said removed air to the exterior of a building in which said hood may be disposed, said filter having a plurality of air conduits extending therethrough;

intake means including a return duct and an intake blower means for introducing fresh air into said hood separately from said exhaust air, said fresh air being directed through said filter air conduits such that said exhausted, heated air preheats said fresh air;

the side and rear walls of said hood being of a hollow construction for directing the flow of said fresh air;

the inside walls of said hood being exposed to heated air, said inside walls further heating said fresh air;

a plurality of exhaust tubes defining said exhaust means, said exhaust tubes being disposed within said return duct such that the fresh air passing through said return duct is preheated by the exhausted, heated air passing through said exhaust duct;

electrical heating means disposed downstream of said filter air conduits;

temperature sensing means for sensing the temperature of the air passing through said air conduits, said electrical heating means being responsive to said temperature sensing means for heating said preheated air to a predetermined value;

a normally closed passage means for bypassing said filter air conduits; and a damper in said passage means for selectively opening said passage means to communicate fresh air downstream of said filter air conduits.

* * * * *